US010976143B2

(12) United States Patent
Muster

(10) Patent No.: US 10,976,143 B2
(45) Date of Patent: Apr. 13, 2021

(54) FULL JACKET SAFETY PROJECTILE, PARTICULARLY FOR MULTIPURPOSE APPLICATIONS

(71) Applicant: RUAG Ammotec AG, Thun (CH)

(72) Inventor: Michael Muster, Thun (CH)

(73) Assignee: RUAG Ammotec AG, Thun (CH)

( * ) Notice: Subject to any disclaimer, the term of this patent is extended or adjusted under 35 U.S.C. 154(b) by 0 days.

(21) Appl. No.: 16/644,618

(22) PCT Filed: Sep. 10, 2018

(86) PCT No.: PCT/EP2018/074315
§ 371 (c)(1),
(2) Date: Mar. 5, 2020

(87) PCT Pub. No.: WO2019/048678
PCT Pub. Date: Mar. 14, 2019

(65) Prior Publication Data

US 2021/0063130 A1 Mar. 4, 2021

(30) Foreign Application Priority Data

Sep. 9, 2017 (WO) ..... PCT/IB2017/055447

(51) Int. Cl.
*F42B 12/74* (2006.01)
*F42B 12/06* (2006.01)
*F42B 12/78* (2006.01)

(52) U.S. Cl.
CPC ..... *F42B 12/74* (2013.01); *F42B 12/06* (2013.01); *F42B 12/78* (2013.01)

(58) Field of Classification Search
CPC ..... F42B 12/06; F42B 12/74; F42B 12/78
USPC ..... 102/518
See application file for complete search history.

(56) References Cited

U.S. PATENT DOCUMENTS

| | | | |
|---|---|---|---|
| 3,208,385 | A | 9/1965 | Pemiss |
| 4,353,302 | A | 10/1982 | Strandli et al. |
| 4,444,112 | A | 4/1984 | Strandli et al. |

FOREIGN PATENT DOCUMENTS

| | | | |
|---|---|---|---|
| BE | 905373 | A | 3/1987 |
| DE | 2323798 | A1 | 11/1974 |
| DE | 2727970 | A1 | 1/1978 |
| DE | 19948710 | A1 | 4/2001 |
| EP | 0531697 | A3 | 3/1994 |

OTHER PUBLICATIONS

International Search Report for PCT/EP2018/074315, dated Nov. 12, 2018, and English Translation submitted herewith (5 pgs.).

*Primary Examiner* — Samir Abdosh
(74) *Attorney, Agent, or Firm* — Fitch, Even, Tabin & Flannery, LLP

(57) ABSTRACT

For the transport and handling of ammunition, the safety level is determined according to the amount of explosive used. Thereby, regulatory constraints are set for example for air transports, which barely suffice for a trial of projectiles. By a specific guidance of shockwaves resulting on impact on a target multilateral, high compressions are evolving inside the acting body (5'), which are initiating the same reliably without additional means or support agents. The subject of the invention aims at great savings of explosive without losses in the effect and significantly increases the safety during transport and handling.

17 Claims, 4 Drawing Sheets

FULL JACKET SAFETY PROJECTILE, PARTICULARLY FOR MULTIPURPOSE APPLICATIONS

CROSS-REFERENCE TO RELATED APPLICATIONS

Figure 1:
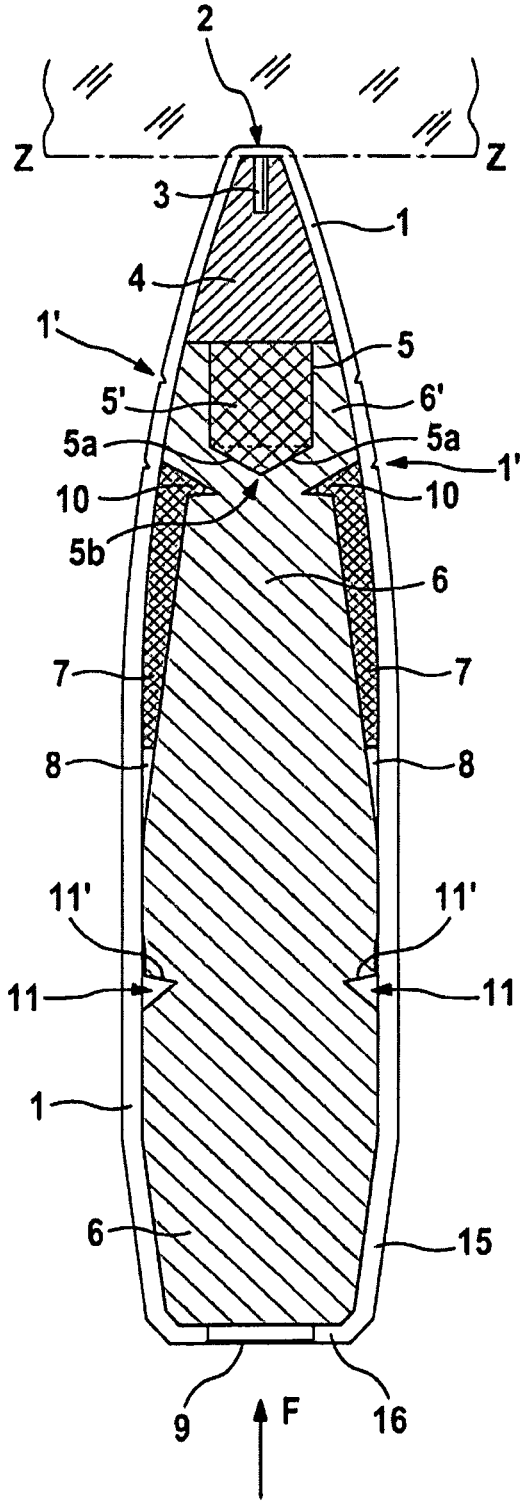

This application is a U.S. national phase application filed under 35 U.S.C. § 371 of International Application No. PCT/EP2018/074315, filed Sep. 10, 2018, designating the United States, which claims priority from International Application No. PCT/IB2017/055447, filed Sep. 9, 2017, which are hereby incorporated herein by reference in their entirety.

The present invention relates to a full jacket safety projectile according to the preamble of the claim.

A safety projectile is referred to as a projectile, which contains only a minimal amount of explosive and is still employable as pure penetration projectile, multipurpose projectile, explosive projectile or incendiary shell.

The safety of ammunition bodies is of importance not only regarding its manipulation but also particularly with regard to its transport. The transnational transport of military equipment and of ammunition is subject to international and national safety regulations as well as national transit regulations and therefore requires time-consuming and expensive authorization processes, particularly in periods of peace.

In addition, small amounts of small caliber ammunition should be dispatched by air cargo at short notice due to temporal or other reasons, for local protection and defense tasks, but also for testing purposes. For this purpose, very strict safety regulations, namely regulations and transport classifications for dangerous goods of the IATA (International Air Transport Association) as well as of ICAO-TI (Specialized Organization of the United Nations for the International Civil Aviation) are in place. The compliance with all legislation and the supervision of all legislation rests on the haulage contractor and particularly directly the members of the IATA and the airport and customs authorities.

Therefore, also for small numbers of small caliber ammunition for the area transportation a successful safety check of the transport goods according to United Nations recommendations are necessary so that the dangerous goods obtain a transport classification for example according to the classification code 1.4 S (UN 0012 among other things bullets for handguns). The packaging is described in detail and the maximum amount of goods to be transported (quantity) of ammunition is specified in the required check certificates. Furthermore, the dangerous goods (bullets including explosive material) is limited to a net total mass of maximum 25 kg. The overall weight of the transport goods should not exceed 50 kg so that relatively tight limits are also defined for the safety measures (transport packaging etc.).

Conventional incendiary shells are known among others from U.S. Pat. No. 3,208,385. For these types of projectiles, a front-sided incendiary agent is initiated on impact on a hard target. A hollow projectile body located behind it is filled with another incendiary agent and contains a predetermined breaking point so that both incendiary agents are acting on its penetration into the target. This type of ammunition has been employed since the 60s for example as tank incendiary shell.

Another incendiary shell is known from DE-OS-2 323 798, this contains a sub-caliber, central penetration core made of hard metal, which is jacked by an incendiary material. The penetration core is put on a same-caliber rear part that acts as sabot and is separated at the target via a predefined breaking point. An explosive agent is located in front of the penetration core, at the same time acting as hit mark.

Analogously acting incendiary shells were later referred to as multipurpose projectiles (DE-A1-27 27 970; U.S. Pat. No. 4,444,112; EP-A3-0 531 697).

An increased penetration power compared to the projectiles mentioned above was achieved according to a European patent application no. 16405018.9. At the same time, the diameter of the penetration drill achieved could be enlarged so that the hydraulic resistance against the explosive agent was reduced and was therefore also effective on the inside of the target.

The necessity of using an explosive agent in the order of 1 g of weight is disadvantageous, also for this improved projectile of caliber 0.5 (12.7 mm), and to add to it highly sensitive pentaerythritol tetranitrate (PETN; german: Nitropenta) for a safe ignition.

It is therefore an objective of the invention to create a projectile with reduced amount of explosive with constant target effect, whose safety in the production and handling is increased compared to the aforementioned. This is to be employed without per se environmentally hazardous materials, such as cores made of tungsten carbide or highly pyrophoric explosive agents, such as zirconium-containing materials. The projectile should also be able to be embodied as tracer ammunition.

The penetration power, for example of a multipurpose projectile should be at least equal to or even be improved with respect to the penetration depth as well as to the penetration diameter compared to the European application no. 16405018.9. The drill at the target should represent only a small flow resistance for the plasmas of the explosive agents. The inner and outer ballistic of the projectiles and the accuracy should also be at least equally high. The projectile design should be manufacturable from few parts cost-effectively and precisely and be producible with conventional means and processes in large numbers. The projectile should also be manufacturable for the use in rifle bullets. The projectiles in small numbers should also be accredited for air transports.

Additionally, no dangerous blind shells should be produced during a possible miss of the target and/or for very soft targets.

This objective is solved by the features of the claim.

The penetration core referred to is preferably one-pieced for manufacturing and dynamic reasons but can also consist of multiple parts. In any case, the transition area between the front part and the actual penetration part is formed for directing the resulting shockwaves so that a stabilized explosive is also initiated on impact on the target, without further aids (such as ignition chains, sensitive explosive materials, etc.). The resulting splinter effect in the front part of the penetration core allows the penetration core to penetrate solid plates with the full kinetic energy.

By the intended guidance of the shockwaves produced during the impact, the amount of explosive material can be basically reduced; the dangerous PENT nowadays often used can furthermore be avoided.

The different run times of opposing shockwaves are in the range of milliseconds so that as a result of the inertia of the explosive agent an extremely high densification and thereby a safe initiation directly follows.

The amount of explosive agent can be reduced significantly according to the object of the invention, as reproducible shooting trials at different targets with a multipurpose projectile of caliber 0.5 showed, the same without blind shells, deflagrations or flashfires.

Advantageous developments of the subject matter of the invention are described in the dependent claims.

According to claim 2, a simple guidance of shockwaves takes place by circumferential notches at the full jacket.

Constrictions with front-sided faces at the penetration core are particularly efficient for the effective reflection of shockwaves according to claim 3.

In a preferred embodiment of the invention, a front-sided face, that means the face causing and aligning the reflection of the shockwaves towards the recess 5, formed as upper wedge face particularly of a wedge-shaped first and/or second constriction. Preferably, the upper wedge face is formed flat, even and conical-shaped particularly regarding opposing the axial direction (F) (shooting direction). Alternatively, the upper wedge face can be formed at least partly, preferably fully, convex, preferably parabolic-shaped (viewed from the outer side of the penetration core) in order to focus the shockwaves to the explosive material at the recess.

Preferably, also the other lower face of the wedge-shaped constriction can either be formed flat, even or convex, particularly parabolic-shaped in addition.

The alignment of the front-sided faces at the penetration core takes place in the simplest manner, in that the alignment is determined geometrically by a central line leading to the target point. This target point is the previously determined point, where a shockwave introduction is most efficient; claim 5.

Rear-sided cone faces with a cone angle according to claim 6 have proven themselves, wherein its geometric tips comply with the previously mentioned target point.

The double function of the first cone-shaped constriction referred to in claim 7 is very space-saving and has been found to be extremely effective.

A good penetration into the target is achieved by a hardened steel tip, which is increased by the introduction of a titanium pin of a kind of a pilot drilling. This hard pin effectuates a high contact pressure at the target so that barely any ricochets take place; claim 8.

The embodiment according to claim 9 results in a highly-effective, continuously burning marking charge and is therefore employed as tracer.

The pyrotechnical mixture according to claim 10 results in a good target marking as it is desired particularly for multipurpose projectiles.

In a preferred embodiment of the invention, the front part of the penetration core, particularly a cup part with a front-sided, blind-hole-shaped recess for filling with explosive material, and a central part of the penetration core is manufactured, particularly turned, in one piece, particularly a metal piece. Preferably, the metal piece is formed of simple steel, without comprising a particular magnesium cobalt additive. The central and rear part of the penetration core is delimited from the front part by a first constriction in the axial direction.

In a further development of the invention, a rear-sided final front face of the penetration core has a plane or even face or alternatively a convex, preferably parabolic-shaped shape for reflecting and aligning, preferably for focusing, shockwaves essentially in the axial direction through the penetration core towards the recess in the front part.

The use claims 13-17 shows an enormously wide range of application of the subject matter of the invention.

With the measures according to the invention, a significant manufacturing advantage was achieved in a way that instead of the usual high-grade magnesium cobalt metal mixture, a simple steel material can be employed in order to achieve the desired function of the safety projectile. In particular, the wedge-shaped constriction or notch delimiting the front part from the central part of the penetration core resulted in a concentration of the deformation forces.

The design of the penetration core in the front part regarding the shape of the recess is particularly advantageous, the recess serving as predetermined compression zone, which is particularly offering the possibility to use a simple steel material for the penetration core.

Surprisingly, a successful angle penetration can be achieved by the full jacket safety projectile even with an angular shooting direction, particularly at a 45° angle. Particularly the compression zone of the front part in the shape of a receiving cap, namely the blind hole-shaped recess supports.

Preferably, circumferential impairments, preferably notches or grooves, are provided in the area of the recess, wherein the impairments can also be arranged axially or spiral-shaped.

Embodiments of the subject matter of the invention are subsequently explained by drawings, wherein for equivalently acting parts the same reference numerals are employed.

Figure 2:
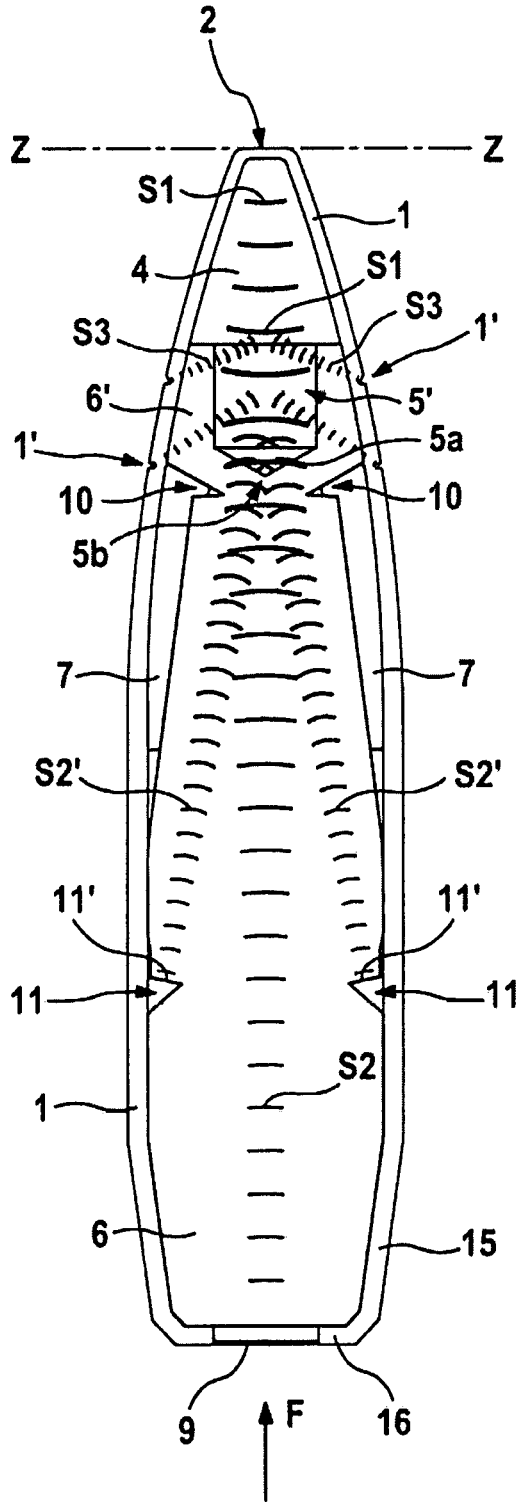
Figure 3:
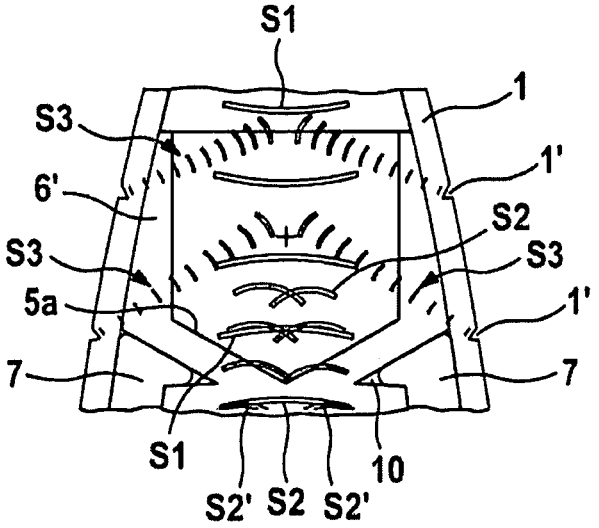
Figure 4:
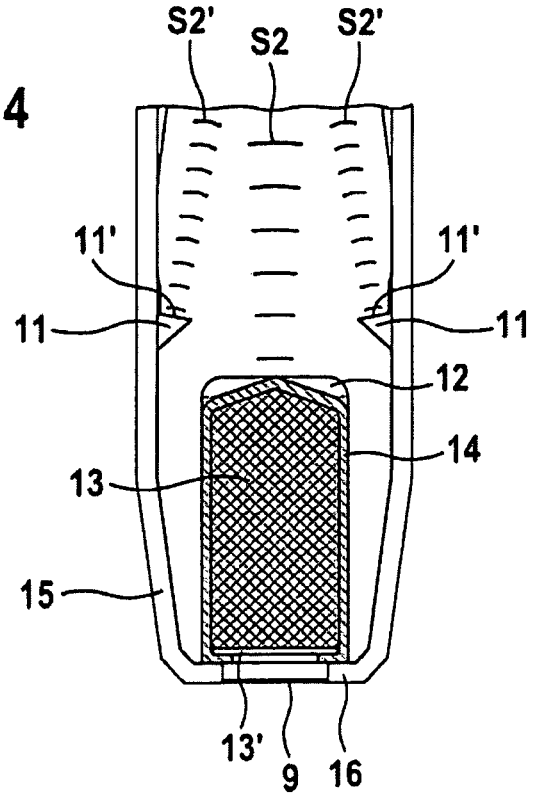
Figure 5:
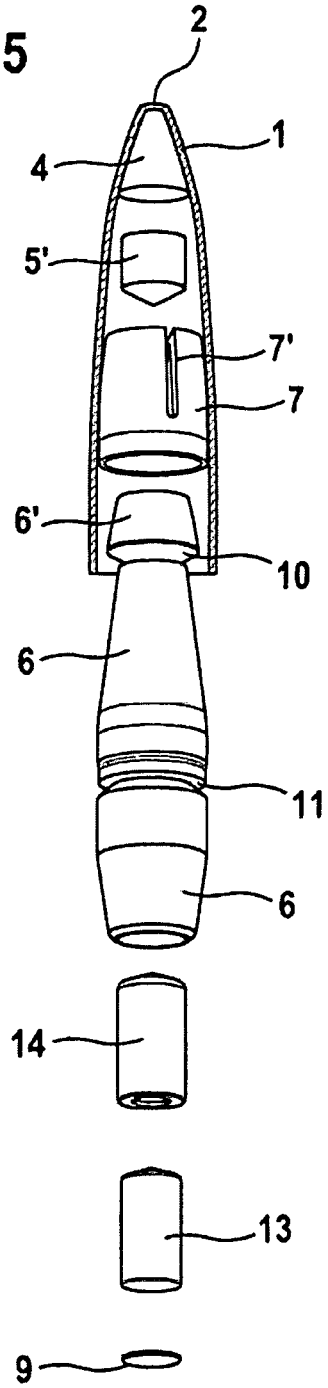
Figure 6:
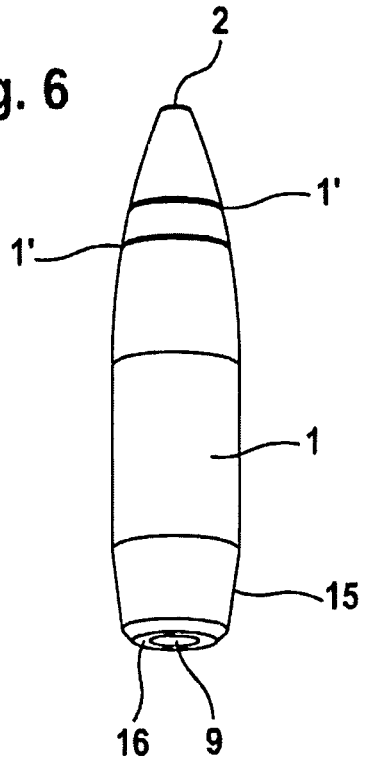

They show:

FIG. 1 a penetration projectile with a highly phlegmatized explosive agent,

FIG. 2 a penetration projectile according to FIG. 1, in simplified depiction, with ground shockwave fronts, immediately on impact on a target, FIG. 3 a detail enlargement of FIG. 2, in the front part of the penetration part with the resulting shockwave fronts, FIG. 4 the rear part of the multipurpose projectile with a marking charge, FIG. 5 the merging (assembly) of the individual parts in a multipurpose projectile, in the version according to FIG. 4 and FIG. 6 the projectile ready for loading.

The full jacket at a penetration projectile of caliber 0.5 is denoted with 1 in FIG. 1; this projectile is shot in a conventional barrel (not depicted) in the flight direction F. The full jacket 1 has a flattened tip 2. An ogival-shaped, hardened steel tip 4 with a front-sided, central titanium pin 3 is embedded in the projectile tip. A one-pieced penetration core 6 with a blind hole-shaped recess 5 is provided following the steel tip 4, its cone faces are denoted with 5*a* and the tip is denoted with 5*b*. A highly-stabilized explosive agent 5' is pressed into the recess 5. The front area 6' of the penetration core 6 has a first wedge-shaped constriction 10, a twist, in which a sleeve made of polymer is extending, which surrounds the central part of the penetration core 6 laterally. The sleeve 7 is cut off at the rear side and keeps clear a void space 8 between the full jacket 1 and the penetration core 6, the void space having an inner ballistic positive effect. A second analogous wedge-shaped constriction 11 is located in the rear part of the penetration core 6, wherein here, the upper wedge face 11' forms a relatively small acute angle against the horizontal. A narrowing 15 is provided on the rear side, serving the introduction of the projectile into a conventional bullet and at the same time is aerodynamically advantageous. The projectile is delimited by a rear-sided sealing disc 9, which is introduced at its notorious known flange 16. The full jacket 1 has circumferential notches 1' (twist) at the frontal area 6' of the penetration core 6.

The materials used are known as such. They are resulting in surprising effects in the content of the invention. A commonly used fine-grain steel with a hardness of 57 HRC is suitable as steel tip 4. The titanium pin 3 of a diameter of 1.2 mm introduced there acts at the target Z in the manner of a pilot drilling and avoids ricochets. Instead of titanium, also titanium carbide or titanium nitride, so-called cermets are qualified. Suitable explosive material are particularly such made of "plastic bonded explosive" (=PBX) or of the type of nitro amine, but is of course not limited to these. The sleeve 7 can employ many functions, particularly when made of a metal compound. On the one hand, it can serve the damping of vibrations and reduce barrel wear and on the other hand, for example mixed with titanium powder, produce a flash on impact on the target, serving as hit indication. Furthermore, the specific addition of metal powder can also be useful for the optimization of the balance point position of the projectile.

The notches 1' as well as the wedge-shaped constrictions 10 act analogously to the subject matter of the invention according to the European patent application no. 16405018.9, forming splinters, and increase the penetration power of the core 6. On the other hand, they serve here additionally for the shock wave guidance as subsequently shown in FIG. 2.

For simplification purposes, the titanium pin 3 is not shown in FIG. 2. The central shockwave front S1 formed on impact at the target experiences a dispersion at the transition to the explosive agent 5', wherein at the same time the lateral waves are reflected at the notches 1' of the full jacket 1 as wave fronts S3. The second wedge-shaped constriction 11 inside the penetration core 6 reflects at its wedge face if lateral wave fronts S2' running towards the center, which are superimposing with the wave fronts S1 and are acting as shock waves with increased power in the explosive agent 5' via the first wedge-shaped constriction 10; cf. FIG. 3, an enlarged depiction in the front part 6' of the penetration core.

This effect, namely the multi-sided compression of the highly-stabilized explosive agent effectuates its entire burn-off with highly increased velocity. The crystalline materials, the actual explosive, come in contact with each other abruptly and on all sides and are therefore initiated at the same time. This allows a reduction of the amount of explosive at the same splinter power, in the order of 70% compared to the projectile according to the European application no. 16405018.9. The term "explosive agent" chosen for the present patent claim indicates that apart from the generally applied explosives also other agents are possible which have not been able to be initiated or have only been able to be initiated over long ignition chains. This also includes agents which are not known as explosive agents per se, that means agents that are also highly stabilized also without conventional stabilization and only become detonatable by specifically high pressures and specific pressure progressions. The resulting increased safety is especially important, in production, during transport, but also while manipulating the ammunition at the place of use. The reduced amount of explosive agent facilitates the compliance of international transport regulations, which can be very important in case of urgent frontline duties.

The resulting conditions in a projectile according to the invention for the initialization of the explosive agent are only evolving on impact on the target (Z). This results in the fact that blind shells—being produced for whatever reasons—are entirely harmless, whereby a further not insignificant contribution to the safety of ammunition is produced.

The design according to the invention allows the design of new types of projectiles with specific effects at the target, indicated by the following example.

The version of a multipurpose projectile can be seen in the sectional depiction FIG. 4. A sleeve 14 made of Tombak, which is provided with a tip, in which a blind hole-like recess 12 is introduced at the rear part of the penetration core 6. The marking charge 13, which is pressed into the sleeve 14, is ignited when being shot by the—not depicted—bullet via the rear-sided sealing 9 and via a small ignitor 13'. This thermally advantageous design distinguishes itself by the homogeneous burn-off, over the entire flight distance of the projectile, and serves as a reliably acting tracer.

FIGS. 5 and 6 show the employed components for the multipurpose projectile in perspective view:

At first, the ogival-shaped tip 4 is introduced into the full jacket 1, FIG. 5. After that, the penetration core 6, into which the explosive agent 5' has been previously pressed in the front area 6' and is locked in into the elastic sleeve 7. This sleeve 7 has at least one radial notch 7' facilitating the assembly and inhibits deformations in the jacket 1. The sleeve 14 and the marking charge 13 are located rear-sided in the penetration core 6; cf. FIG. 4.

Afterwards, the sealing 9 is introduced and the rear side of the entire projectile is provided with a flange 16, see FIG. 6.

The subject matter of the invention represents an open design, that means that same can be modified in different manners, can be combined with different materials and can be adapted to the desired, specific purpose of application, for example among others also by means of inlays of metal splinters. According to model regulations, also medium and large caliber weapons can be realized in an analogous manner.

For the increase of the penetration power, particularly for larger calibers, the cylindrical shaft of the penetration core 6 can likewise be formed ogival-shaped.

Practical trials, in comparison with analogous projectiles have shown that the amount of explosive agents can be reduced to about a third.

Generally, the subject matter of the invention is not limited to police or military applications: In machine construction, mining, civil engineering, but also during the exploration of raw materials, penetrations and drills are permanently necessary, which have to be executed only with minimal use of explosives for security and environmental reasons. The use claims 13-17 outlines these applications but are by no means exclusive.

LIST OF REFERENCE NUMERALS

1 full jacket (penetration or multipurpose projectile, respectively)
1' notches (circumferential) in 1
2 flattened tip
3 titanium pin (possibly titanium carbide)
4 steel tip (hardened)
5 blind hole-shaped recess in 6
5*a* cone faces of 5
5*b* tip of 5
5' explosive agent (PBX/nitroamine)
6 penetration core
6' front area of 6
7 elastic sleeve (polymer/metal compound)
7' slit in 7
8 void space (ring-shaped)
9 rear disc (sealing)

10 first wedge-shaped constriction (twist)
11 second wedge-shaped constriction (twist)
11' upper wedge shape of 11
12 blind hole-like recess in 6
12' tip of the recess 12
13 marking charge (tracer)
13' ignitor for 13
14 sleeve
15 narrowing
16 flange
F flight direction of the projectile
S1-S3 shockwave fronts
Z target

The invention claimed is:

1. Full jacket safety projectile with a central penetration core centered in the full jacket with a front-sided, blind hole-like recess being filled with an explosive agent, wherein the penetration core having at least one first and one second wedge-shaped constriction, wherein on impact on a target the resulting central shockwave acting front-sided on the explosive agent and the recess in the penetration core splinters inside the target, wherein at circumferential notches and/or wedge-shaped constrictions shockwaves (S1, S2) are reflected at the full jacket and/or in the penetration core and that the same are impinging the explosive agent, by opposingly directed shockwaves (S1, S3; S2'), so that compressions counteracting to each other are evolving, which are directly initiating the explosive agent.

2. Full jacket safety projectile according to claim 1, wherein a part of the outer lying shockwaves (S1) being guided from circumferential notches of the full jacket to the recess.

3. Full jacket safety projectile according to claim 1, wherein a part of the outer lying shockwaves (S1) being reflected on a front-sided face of the second constriction of the penetration core and being guided to a rear-sided tip of the recess.

4. Full jacket safety projectile according to claim 1, wherein a front-sided face of the first and/or second constriction being an upper wedge face, which is particularly formed flatly or convexly.

5. Full jacket safety projectile according to claim 1, wherein a front-sided face of the second constriction being aligned orthogonally to the presumptive, reflected shockwave (S2').

6. Full jacket safety projectile according to claim 1, wherein the recess forming a rear-sided cone face with a tip, wherein the resulting cone angle is 90° to 130°, preferably 120°.

7. Full jacket safety projectile according to claim 1, wherein the first wedge-shaped constriction being formed in such a way that they let the main amplitudes of the reflected shockwave (S2') to pass through and that they are optimal predetermined breaking points (Z).

8. Full jacket safety projectile according to claim 1, wherein the steel tip being hardened and containing a central titanium pin.

9. Full jacket safety projectile according to claim 1, wherein the penetration core providing a blind hole-like recess at the rear side, in which a metallic sleeve is introduced, which contains a marking charge.

10. Full jacket safety projectile according to claim 1, wherein the elastic sleeve comprises a pyrotechnical mixture, wherein a polymer matrix, preferably polyether ketone, contains embedded metal powder, like titanium, magnesium, aluminum or zirconium and/or mixtures of the same.

11. Full jacket safety projectile according to claim 1, wherein the penetration core and a front part forming the front-sided, blind hole-like recess being made in one piece, particularly metal piece, wherein particularly the one-pieced penetration core is formed of steel preferably without a magnesium cobalt additive.

12. Full jacket safety projectile according to claim 1, wherein a rear-sided front face of the penetration core being formed evenly or convexly, particularly in that shockwaves (S2) are focused towards the recess.

13. Use of a full jacket safety projectile according to claim 1 for the specific arrest of getaway vehicles.

14. Use of a full jacket safety projectile according to claim 1 as multipurpose projectile against lightly armored objects.

15. Use of a full jacket safety projectile according to claim 1 in the manufacturing or repair technology and in rescue services, for forming drill holes without tool machines.

16. Use of a full jacket safety projectile according to claim 1 in mining, in civil engineering for the preparation of blast holes, outlet bores, injections and pressure releases.

17. Use of a full jacket safety projectile according to claim 1 for the stepwise drift of bore holes during the exploration of raw materials.

* * * * *